United States Patent [19]

Kast

[11] Patent Number: 4,470,337

[45] Date of Patent: Sep. 11, 1984

[54] FAIL-FIXED SERVOVALVE WITH POSITIVE FLUID FEEDBACK

[75] Inventor: Howard B. Kast, Fairfield, Ohio

[73] Assignee: General Electric Company, Cincinnati, Ohio

[21] Appl. No.: 395,569

[22] Filed: Jul. 6, 1982

[51] Int. Cl.[3] ..... F15B 11/08; F15B 13/044; F15B 15/17

[52] U.S. Cl. ..... 91/3; 91/417 R; 91/459; 91/461

[58] Field of Search ..... 91/3, 359, 360, 417 R, 91/459, 461; 137/83

[56] References Cited

U.S. PATENT DOCUMENTS

| | | | |
|---|---|---|---|
| 3,766,832 | 10/1973 | Hayner | 91/359 |
| 4,227,443 | 10/1980 | Toot | 91/459 |
| 4,265,162 | 5/1981 | Neradka et al. | 91/3 |
| 4,276,809 | 7/1981 | Kast | 91/417 R |

OTHER PUBLICATIONS

Electromechanical Design–Pure Fluid Amplification, Jun. 1960, pp. 60, 61.

*Primary Examiner*—Robert E. Garrett

*Assistant Examiner*—Abram McConnell Bradley, IV

*Attorney, Agent, or Firm*—Greogory A. Welte; Derek P. Lawrence

[57] ABSTRACT

The servovalve includes a primary jet of fluid. A variable control signal is adapted to vary the angular position of the primary jet from its maximum recovery position. A first fluid path is adapted to supply fluid to a servopiston at a variable pressure determined at least in part by the control signal. A second fluid path is adapted to receive a predetermined portion of the primary jet fluid when the control signal reaches a predetermined value. The second fluid path terminates in the vicinity of the primary jet and is adapted to direct a secondary jet of fluid at the primary jet to deflect the primary jet toward the input orifice of the second fluid path. The resultant positive fluid feedback in the second fluid path causes the primary jet to latch in a first angular position relative to the maximum recovery position when the control signal reaches a predetermined value. The servovalve may further include a means to discharge the fluid and a means to block the first fluid path to the servopiston when the control signal falls below a second predetermined value. A method of operating a fail-fixed servovalve is also described.

8 Claims, 6 Drawing Figures

FAIL-FIXED SERVOVALVE WITH POSITIVE FLUID FEEDBACK

This invention herein described was made in the performance of work under a NASA contract and is subject to the provisions of section 305 of the National Aeronautics and Space Act of 1958, Public Law 85-568 (72 Stat. 435; 42 U.S.C. 2457).

BACKGROUND OF THE INVENTION

The present invention relates in general to servovalves and in particular to fail-fixed servovalves which use positive fluid feedback.

It is known to use servovalves at the interface between an electrical control system and different types of mechanical or hydraulic actuating devices. For example, in a gas turbine engine fuel control system the servovalve may control the movement of a servopiston in response to an electrical control signal.

In certain types of control systems, it is desirable to use a fail-fixed servovalve for controlling the movement of the servopiston. The expression fail-fixed servovalve, as used herein, designates a servovalve which has no mechanical output in the event the electrical control signal is either lost or exceeds a maximum rated control signal value, i.e. the servopiston is locked in position when these situations occur. An example of a servovalve which is fail-fixed when the control signal is lost is described in U.S. Pat. No. 4,276,809, assigned to the assignee of the present invention. The fail-fixed servovalve described in the above-mentioned patent utilizes a shuttle piston which blocks the flow of fluid to a servopiston chamber when the control signal falls below a predetermined value. Such a servovalve is, however, fail-fixed only for control signals which do not exceed a predetermined value.

OBJECTS OF THE INVENTION

It is a primary object of the present invention to provide a new and improved fail-fixed servovalve.

It is a further object of the present invention to provide a simple and reliable fail-fixed servovalve which can be fabricated at relatively low cost.

It is an additional object of the present invention to provide a new and improved fail-fixed servovalve which is less sensitive to contaminate in the fluid than heretofore available servovalves of this kind.

It is another object of the present invention to provide a new and improved fail-fixed servovalve which employs positive fluid feedback to lock the servopiston in position when the control signal exceeds a predetermined value.

These, as well as additional objects of the present invention, together with the features and advantages thereof will become apparent from the following detailed specification when read together with the accompanying drawings.

SUMMARY OF THE INVENTION

In one form of the invention, I provide for a fail-fixed servopiston comprising a means for providing a primary jet of fluid and a means responsive to a variable control signal for varying the angular position of said primary jet from a maximum recovery position. First and second fluid paths include first and second input orifices respectively. The first fluid path is adapted to supply fluid to the servopiston at a variable pressure determined at least in part by the control signal. The first input orifice is positioned to substantially maximize the amount of primary jet fluid received by the first fluid path when the primary jet is in the maximum recovery position. The second orifice is positioned to receive a predetermined portion of the primary jet of fluid when the control signal reaches a predetermined value. The second fluid path terminates in the vicinity of the primary jet and directs a secondary jet of fluid at the primary jet to produce positive fluid feedback in the second fluid path. Additionally, a third fluid path for discharging fluid entering the third fluid path through a third input orifice may be part of the servovalve. The third input orifice is positioned to substantially maximize the amount of primary jet fluid received by the third fluid path when the primary jet is on the opposite side of the maximum recovery position relative to a first angular position.

DETAILED DESCRIPTION OF THE INVENTION

Figure 1:
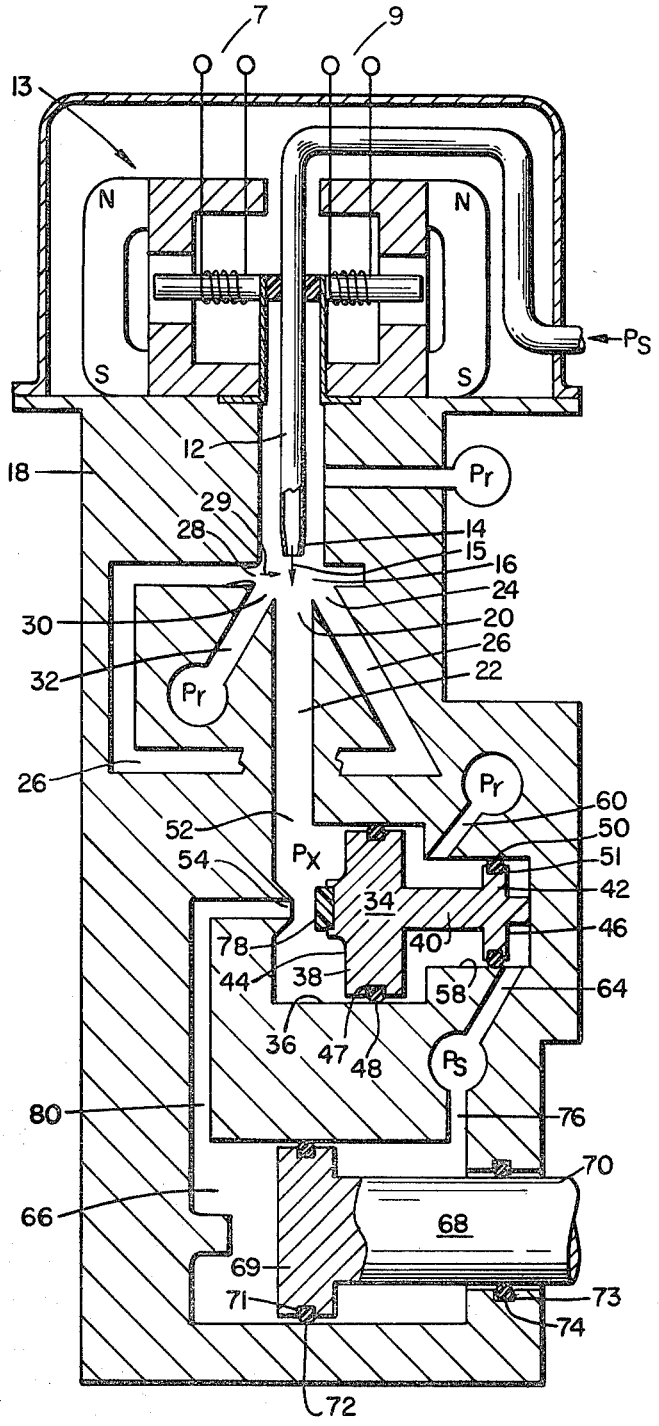
FIG. 1 is a cross-sectional view of one embodiment of a fail-fixed servovalve in accordance with the principles of the present invention.

Referring now to FIG. 1 of the drawings, there is illustrated a preferred embodiment of a fail-fixed servovalve which includes a housing 18. The servovalve comprises an angularly moveable jet pipe 12 having a nozzle 14 which is capable of delivering a primary jet 15 of fluid into a primary chamber 16 in housing 18. Jet pipe 12 receives fluid at a pressure $P_s$ from a source of high pressurized fluid not shown in FIG. 1. The angle of jet pipe 12 may be varied from its maximum recovery position shown in FIG. 1 by means of a conventional torque motor 13 or other means responsive to a selectively variable control signal applied at terminals 7 and 9.

As shown in FIG. 1, there are three input orifices, conventionally known as receivers, toward which jet pipe 12 may direct the pressurized fluid, each adapted to admit fluid to a separate fluid path. A first fluid path includes a receiver tube 22, a shuttle piston 34 and it terminates at servopiston bore 66. Receiver tube 22 receives fluid through a first input orifice or receiver 20. In the preferred embodiment of the invention, the diameter of receiver 20 is about 1.2 times the relatively small inside diameter of nozzle 14.

A second receiver 24 or input orifice admits fluid to a second fluid path which includes a feedback receiver tube 26 and an output orifice or nozzle 28 positioned in the vicinity of nozzle 14. The second fluid path is adapted to provide a secondary jet 29, which is seen to be directed at primary jet 15. A third input orifice or receiver 30 is adapted to admit fluid to a third fluid path which includes a discharge tube 32 adapted to communicate with a fluid sump not shown in the drawing. The sump pressure $P_r$ is relatively low compared to supply pressure $P_s$.

Shuttle piston 34 is moveably disposed in a chamber within housing 18. The shuttle piston includes first and second piston heads 38 and 42 respectively, each affixed to a piston rod 40 at opposite ends of the rod. Piston heads 38 and 42 include piston faces 44 and 46 respectively. The area $A_2$ of piston face 44 is selected to be larger than area $A_1$ of piston face 46. In one embodiment of the invention, these areas are selected such that $A_2/A_1=6$.

Piston head 38 is adapted to reciprocate in a bore 36. This piston head includes a groove 47 which holds one or more O-rings 48. The O-rings are adapted to make sealing contact with the wall of bore 36 in which piston head 38 is moveably disposed. Similarly, piston head 42 is moveably disposed in a bore 58 and sealingly engages the wall of the latter bore by means of one or more O-rings 50. The latter are retained in a groove 51 of piston head 42.

Bore 36 includes an output port 54, as well as an input port 52 which communicates with receiver tube 22. Shuttle piston 34 essentially divides the chamber in which it is disposed into three spaces of variable volume. The first of these spaces, to the left of piston face 44 in FIG. 1, communicates between receiver tube 22 and output port 54 and thus forms part of the first fluid path. The second space, disposed between piston heads 38 and 42, communicates with the low pressure fluid sump at pressure $P_r$ through a fluid vent 60. The third space, positioned to the right of piston face 46 in FIG. 1, communicates with the high pressure fluid supply at pressure $P_s$ through a supply passage 64.

Housing 18 includes a further bore 66 which communicates with port 54 through a passage 80. Thus, passage 80 extends the first fluid path to bore 66, in which servopiston 68 is moveably disposed. Servopiston 68 may be coupled to a mechanical fuel metering valve, not shown, or to another actuating device, by means of a piston rod 70. Servopiston 68 sealingly engages the wall of bore 66 by means of O-rings 72 and 74 which reside in grooves 71,73 disposed in servopiston head 69 and housing 18 respectively. High pressure fluid is supplied to bore 66 at pressure $P_s$ through a supply passage 76 which communicates with the high pressure fluid supply.

Figure 4:
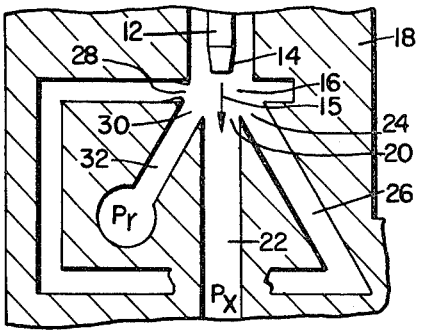
FIG. 4 is a detailed view of a portion of the servovalve of FIG. 1 which schematically illustrates the direction of the primary jet when the latter is in its maximum recovery position.

As shown in FIG. 1 and in greater detail in FIG. 4, jet pipe 12 is in its maximum recovery position. In a preferred embodiment of the invention, this position corresponds to slightly less than 80% of the maximum rated control signal applied to torque motor 13. In the maximum recovery position, the amount of fluid from primary jet 15 which enters first receiver 20 is substantially maximized. The pressure resulting from this maximum fluid flow is designated recovered pressure $P_x$ and is so shown in FIG. 1. Recovered pressure $P_x$ acts on shuttle piston face 44. When the relative piston face areas are $A_2=6A_1$, the shuttle piston 34 will be forced against its right hand stop, if $P_x \geqq 1/6P_s$. The required balancing force on piston face 46 is thus $A_1P_s$. When the recovered pressure drops to a level where $P_x$ is less than $P_s/6$, the shuttle piston 34 will move to its left hand stop to close output port 54. A soft seating seal 78 is adapted to make sealing contact with port 54. The presence of seal 78 permits a degree of tolerence with respect to any contaminate that may be present in the fluid. Only when the recovered pressure $P_x$ is greater than one-sixth of the supply pressure $P_s$, does the position of servopiston 68 become a function of $P_x$. For all values of $P_x$ below that level, piston 34 will close port 54 and thereby block the first fluid path.

Figure 5:
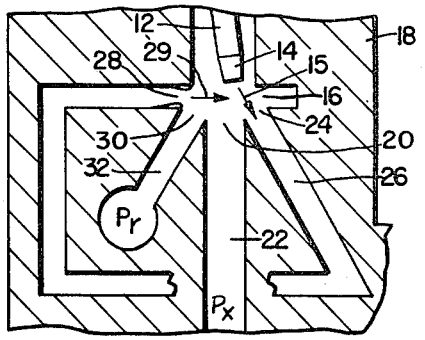
FIG. 5 is a detailed view of a portion of the servovalve which schematically illustrates a first angular position of the primary jet when the control signal is at its predetermined value.

The recovered pressure $P_x$ generally is a function of the percentage of the maximum rated control signal which is applied to torque motor 13 within prescribed limits. When the control signal reaches a predetermined value (80% of the maximum rated control signal in the example under consideration) jet pipe 12 will pivot to the right as illustrated in FIG. 5. At a predetermined angular position relative to the maximum recovery position, this action causes primary jet 15, which is schematically illustrated by an arrow in FIG. 5, to at least partially enter input orifice 24, and hence tube 26. The flow of fluid in the second fluid path produces secondary jet 29 at output orifice 28, the latter jet being directed at primary jet 15 and being adapted to deflect the latter toward input orifice 24. Thus a positive feedback action occurs which causes even more of the primary jet fluid to enter input orifice 24. The reinforcing effect of the positive feedback action finally causes the primary jet 15 to latch in an extreme angular position, or first angular position, with respect to the maximum recovery position. When latching occurs, fluid flow through the first fluid path quickly diminishes and hence the recovered pressure $P_x$ falls. When the force determined by the relationship $6A_1P_x$ falls below the leftward-directed force applied to the shuttle piston, $(A_1P_s)$ the latter moves to the left in FIG. 1 and blocks passage 80 by closing port 54. With the first fluid path thus blocked, servopiston 68 is locked in position. Thus, the positive feedback action provided in accordance with the present invention produces fail-fixed operation of the servopiston when the control signal reaches or exceeds the predetermined value of 80% the maximum rated control signal.

In the discussion herein, it will be understood that the deflection of the primary jet may be due to the pivoting action of jet pipe 12, or the angularly changed path imposed on the primary jet by the secondary jet without further pivoting of the jet pipe, or both. In either case, it results in positive feedback of the fluid in the second fluid path.

Figure 6:
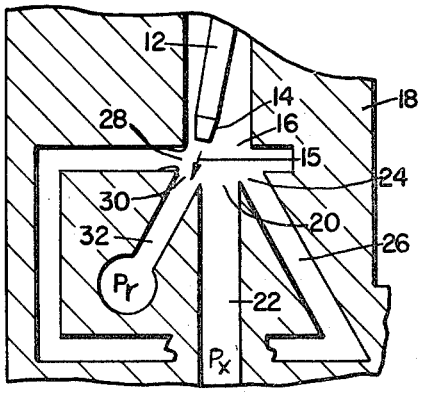
FIG. 6 is a detailed view of a portion of the servovalve which schematically illustrates a second angular position of the primary jet pipe when the control signal is at zero.

When the control signal decreases from a value slightly below 80% of the maximum rated control signal, jet pipe 12 will pivot angularly to the left in FIG. 1. This movement of the jet pipe continues as the amplitude of the control signal decreases, until the jet pipe assumes an angular position on the opposite side of the aforementioned position as illustrated in FIG. 6. In the example under consideration, at 0% maximum rated control signal, primary jet 15 occupies a second angular position, which is roughly symmetrically opposite the extreme angular position to the right of the maximum recovery position. In the second angular position, the primary jet fluid received by receiver 30, and hence by discharge tube 32, is substantially maximized. The fluid so entering the third fluid path is discharged to the low pressure fluid sump, as explained above. In this operating condition, the recovered pressure $P_x$ is low. Accordingly, shuttle piston 34 is at its left-most position, output port 54 is closed and the first fluid path is blocked. Consequently, servopiston 68 is again locked in place in its left-most position. This type of fail-fixed operation for control signals below a predetermined threshold is described in detail in U.S. Pat. No. 4,276,809 to Kast, which is assigned to the assignee of the present invention and which is incorporated by reference herein.

Only when the control signal remains between first and second predetermined signal values, is piston 34 in a position to keep output port 54 open. Between these two values, any change in the control signal produces an angular change of the position of jet pipe 12 and thus a corresponding variation of the amount of fluid in the first fluid path. The variation of fluid flow causes the recovered pressure $P_x$ to change, which in turn, by the process explained above, produces a corresponding change in the position of servopiston 68.

Figure 2:
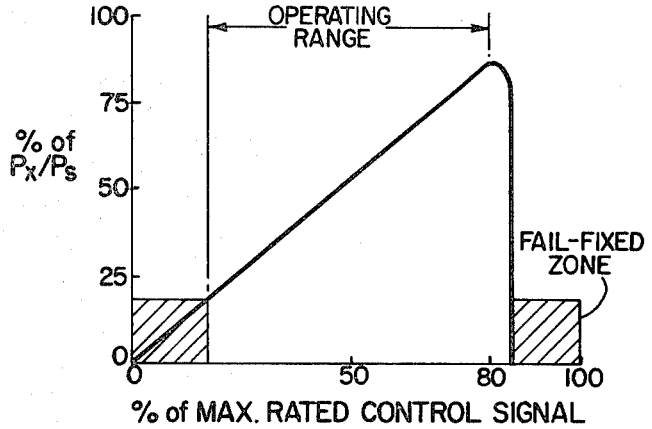
FIG. 2 is a graphical representation of the percentage of the ratio of recovered pressure to supply pressure as a function of the maximum rated control signal.

FIG. 2 is a graphical representation of the operating characteristics of one embodiment under discussion. The ordinate represents the ratio in percentage points, of the recovered pressure $P_x$ to the supply pressure $P_s$. The abscissa plots the percentage of the maximum rated control signal applied to the torque motor 13, or to other means, for angularly varying the direction of the primary jet of fluid. The fail-fixed zone is shown shaded. The positive feedback action of the servovalve is graphically shown by the sharp drop in the $P_x/P_s$ ratio above 80% of maximum rated control signal.

Figure 3:
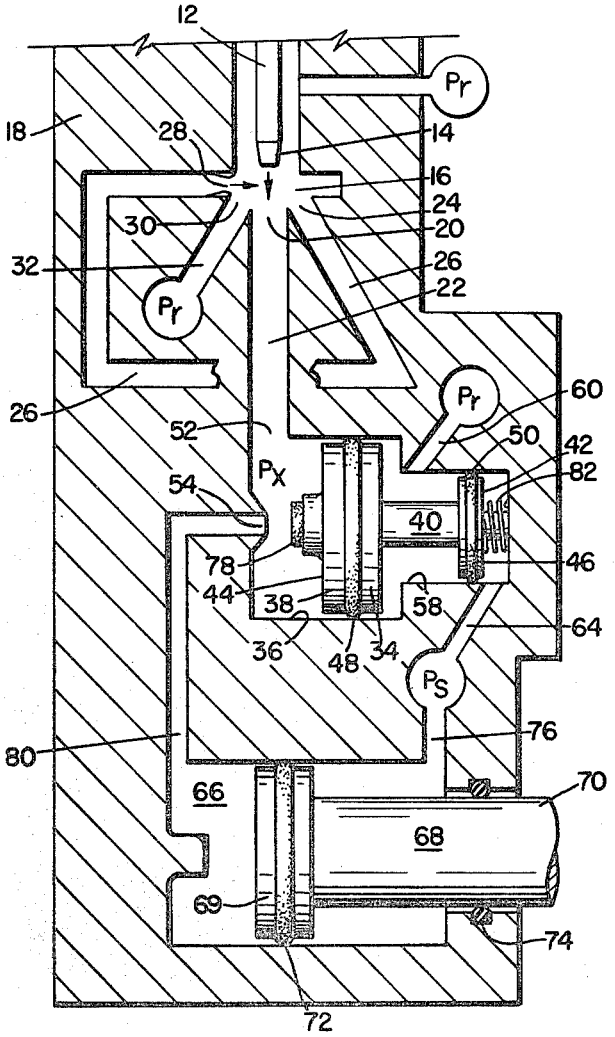
FIG. 3 is a cross-sectional view of another embodiment of the fail-fixed servovalve in accordance with the invention.

FIG. 3 shows an alternate embodiment of the present invention in which shuttle piston 34 is biased toward output orifice 54 by a spring 82. In this arrangement, the servovalve is fail-fixed when the supply pressure $P_s$ is lost. Should such a condition occur, shuttle piston 34 will move to the left in FIG. 3 and will close output port 54 by means of seal 78. As before, this action locks servopiston 68 in place. In all other aspects the structures of FIGS. 1 and 3 are similar, with similar parts designated by the same numerals.

It will be understood that the present invention is not limited to the particular embodiments which are specifically disclosed herein. For example, the positive fluid feedback described and claimed herein could be used in a two-stage servovalve rather than in the single stage valve described and illustrated herein. Further, the location and shape of the positive fluid feedback output nozzle 28 may be changed to obtain different latching characteristics. Likewise, slight variations in the location, shape and direction of feedback receiver tube 26 and receiver 24 can alter the rate of change of $P_x/P_s$ and hence the latching characteristics of the servovalve. The exemplary area ratio given above may be varied and likewise the control signal amplitude at which the jet pipe assumes its maximum angle may be at a different value.

The fact that different devices may be employed to vary the angle of the primary jet has already been remarked. Also, the deflection of the primary jet, as stated above, may be accomplished in a number of different ways. Specifically, the jet pipe may be angularly pivoted; 1 only the jet fluid emitted by the jet pipe may be angularly deflected; or a combination of both techniques may be employed.

Thus, from the foregoing discussion it will be clear that the present invention is not limited to the apparatus and method specifically disclosed herein, but that numerous modifications, partial and complete substitutions, equivalents and changes will now occur to those skilled in the art, all of which fall within the scope of the invention. Accordingly, it is intended that the invention disclosed herein be limited only by spirit and scope of the appended claims.

What is claimed is:

1. Apparatus for providing fail-fixed operation of a servopiston comprising:

means for providing a primary jet of fluid;

means responsive to a variable control signal for varying the angular position of said primary jet from a maximum recovery position;

at least first and second fluid paths including first and second input orifices respectively;

said first fluid path being adapted to supply fluid to said servopiston at a variable pressure determined at least in part by said control signal;

said first input orifice being positioned to substantially maximize the amount of primary jet fluid received by said first fluid path when said primary jet is in said maximum recovery position;

said second orifice being positioned to receive a predetermined portion of said primary jet fluid when said control signal reaches a predetermined value; and said second fluid path terminating in the vicinity of said primary jet for directing a secondary jet of fluid at said primary jet adapted to produce positive fluid feedback in said second fluid path.

2. Apparatus in accordance with claim 1 wherein said secondary jet is adapted to deflect said primary jet in the direction of said second orifice to produce said positive fluid feedback; and wherein said deflected primary jet is caused to latch in an extreme angular position relative to said maximum recovery position when said control signal exceeds said predetermined value.

3. Apparatus in accordance with claim 2 wherein said second orifice is positioned to substantially maximize the amount of primary jet fluid received by said second fluid path when said control signal reaches one hundred percent of said apparatus' maximum rated control signal.

4. Apparatus in accordance with claim 2 wherein said extreme angular position constitutes a first angular position and further comprising:

a third fluid path for discharging fluid entering said third path through a third input orifice; and said third input orifice being positioned to substantially maximize the amount of primary jet fluid received by said third fluid path when said primary jet is at a second angular position on the opposite side of said maximum recovery position relative to said first angular position.

5. Apparatus in accordance with claim 4 and further comprising:

a shuttle piston cylinder having input and output ports communicating with said first fluid path and said servopiston respectively;

a shuttle piston slidably disposed in said cylinder; and means for closing one of said ports with said shuttle piston when the pressure at said one port falls below a predetermined pressure level so as to block said first fluid path.

6. A method for the fail-fixed operation of a servopiston comprising the steps of:

providing a primary jet of fluid;

supplying fluid to said servopiston through a first fluid path at a variable pressure determined at least in part by the angular position of said primary jet;

varying said angular position relative to a maximum recovery position in response to a selectively variable control signal, said primary jet being adapted to direct at least a portion of its fluid into a second fluid path beyond a predetermined angular position of said primary jet, said second fluid path being adapted to terminate in a secondary jet directed at said primary jet; and producing positive fluid feedback in said second fluid path when said control signal reaches a predetermined value by causing said secondary jet to deflect said primary jet toward said second fluid path.

7. A method as recited in claim 6 wherein said step of producing positive fluid feedback further includes the step of latching said primary jet in an extreme angular position beyond said predetermined angular position.

8. A method as recited in claim 6 or 7 and further including the step of blocking said first fluid path when said variable pressure in said first fluid path falls below a predetermined value.

* * * * *